US006263763B1

(12) United States Patent
Feigel, Jr. et al.

(10) Patent No.: US 6,263,763 B1
(45) Date of Patent: Jul. 24, 2001

(54) POWER TONG AND BACKUP TONG SYSTEM

(75) Inventors: Kurt R. Feigel, Jr.; Vladimir G. Pohnert; Marcin K. Barker, all of Edmonton (CA)

(73) Assignee: Universe Machine Corporation, Edmonton (CA)

( * ) Notice: Subject to any disclaimer, the term of this patent is extended or adjusted under 35 U.S.C. 154(b) by 0 days.

(21) Appl. No.: 09/299,912

(22) Filed: Apr. 28, 1999

(30) Foreign Application Priority Data

Apr. 21, 1999 (CA) ..... 2269393

(51) Int. Cl.[7] ..... B25B 13/50
(52) U.S. Cl. ..... 81/57.34; 81/57.35; 81/57.19
(58) Field of Search ..... 81/57.33, 57.34, 81/57.35, 57.19, 57.2, 57.21, 57.15, 57.16, 57.17, 57.24, 57.4, 57.41, 186, 421–424

(56) References Cited

U.S. PATENT DOCUMENTS

| | | | | |
|---|---|---|---|---|
| 3,308,691 | | 3/1967 | Guier | 81/54 |
| 4,099,429 | | 7/1978 | Hauk | 81/57.17 |
| 4,402,239 | | 9/1983 | Mooney | 81/57.16 |
| 4,649,777 | | 3/1987 | Buck | 81/57.19 |
| 4,732,061 | * | 3/1988 | Dinsdale | 81/57.34 |
| 5,099,725 | | 3/1992 | Bouligny, Jr. et al. | 81/57.34 |
| 5,537,900 | * | 7/1996 | Schaar | 81/57.33 |
| 5,542,318 | * | 8/1996 | Wesch, Jr. | 81/57.33 |
| 5,664,310 | | 9/1997 | Penisson | 29/407.02 |
| 5,791,206 | * | 8/1998 | Daigle et al. | 81/57.33 |
| 5,819,604 | | 10/1998 | Buck | 81/57.18 |

FOREIGN PATENT DOCUMENTS 2097089 2/1998 (CA) ..... B25B/13/50

OTHER PUBLICATIONS

Brochure entitled Hydraulic Backup With SE BTM & TL Systems, Universe Machine, Edmonton, Alberta, Canada, printed in Canada on Mar. 26, 1999, 2 pages.

* cited by examiner

*Primary Examiner*—D. S. Meislin
(74) *Attorney, Agent, or Firm*—Anthony R. Lambert

(57) ABSTRACT

A power tong system, comprising a frame having a rear support and a front support, the front support comprising a first front leg and a second front leg; and a power tong mounted in the frame with the power tong extending transversely between the first front leg and the second front leg, the first front leg and the second front leg forming a guide preventing transverse motion of the power tong while allowing vertical movement of the power tong. The system is also preferably provided with a backup tong. The sides of the power tong are preferably provided with rollers to prevent friction between the power tong and the guide. In a second power tong system, a load cell assembly is provided in which a load cell is linked by a series of links to the power tong such that movement by the power tong in either of two transverse directions loads the load cell. In a third power tong system, an improved backup tong is provided in which jaws, preferably symmetrically disposed on the backup tong and each carrying dies, are moved about pivots by a rigid link between the jaws and a linear actuator. The dies are preferably provided with more than one die seat for locating the dies at different positions on the jaws. A third die may be provided, preferably symmetrically arranged with the dies on the jaws. The third die may be located on the linear actuator.

21 Claims, 10 Drawing Sheets

JAWS IN NOMINAL POSITION

JAWS IN NOMINAL SIZE + 1 INCH POSITION

POWER TONG AND BACKUP TONG SYSTEM

FIELD OF THE INVENTION

This invention relates to power tongs and backup tongs used for making and unmaking joints between threaded tubulars.

BACKGROUND OF THE INVENTION

Making and breaking threaded joints of tubulars used in oil and gas drilling and production is typically accomplished using a backup tong and a power tong.

Lateral and axial forces on the threaded joints imparted by the power tong or the backup tong may cause damage to them. The power tong system described here provides reduction of lateral and axial forces on the joints.

SUMMARY OF THE INVENTION

In a first power tong system, lateral forces on joints are reduced by providing the power tong with a guide system that constrains the power tong against movement.

There is thus provided according to an aspect of the invention, a power tong system, comprising a frame having a rear support and a front support, the front support comprising a first front leg and a second front leg; and a power tong mounted in the frame with the power tong extending transversely between the first front leg and the second front leg, the first front leg and the second front leg forming a guide preventing transverse motion of the power tong while allowing vertical movement of the power tong. The system is also preferably provided with a backup tong. The constraint is preferably provided by using a roller on the sides of the power tong, to prevent excessive wear on the power tong and reduce friction between the tong and the guide. Supporting the power tong in a guide with roller bearings reduces bending or shear forces, while providing accurate torque readings and improved thread connections.

In a second power tong system, a load cell assembly is provided in which a load cell is linked by a series of links to the power tong such that movement by the power tong in either of two transverse directions loads the load cell. Two ways of accomplishing this are also provided, though others are possible.

In a third power tong system, an improved backup tong is provided in which jaws, preferably symmetrically disposed on the backup tong and each carrying dies, are moved about pivots by a rigid link between the jaws and a linear actuator. The dies are preferably provided with more than one die seat for locating the dies at different positions on the jaws. This makes the power tong capable of biting casing and a coupling with the same jaws, thus eliminating the need to change jaw sizes, or using additional jaw sets. A third die may be provided, preferably symmetrically arranged with the dies on the jaws. The third die may be located on the linear actuator.

The characteristics of the first, second and third power tong systems are preferably combined in a single system.

These and other aspects of the invention are described in the detailed description of the invention and claimed in the claims that follow.

BRIEF DESCRIPTION OF THE DRAWINGS

There will now be described preferred embodiments of the invention, with reference to the drawings, by way of illustration only and not with the intention of limiting the scope of the invention, in which like numerals denote like elements and in which.

DETAILED DESCRIPTION OF PREFERRED EMBODIMENTS

In this patent document, the word "comprising" is used in its non-limiting sense to mean that items following the word in the sentence are included and that items not specifically mentioned are not excluded. The use of the indefinite article "a" in the claims before an element means that one of the elements is specified, but does not specifically exclude others of the elements being present, unless the context clearly requires that there be one and only one of the elements. A rigid rod or link is a rod or link that can transmit forces in both directions along the rod or link. By contrast, a loose link is a link in which forces are transmitted in only one direction along the link, as in the case of a wire, chain or rope.

Figure 1:
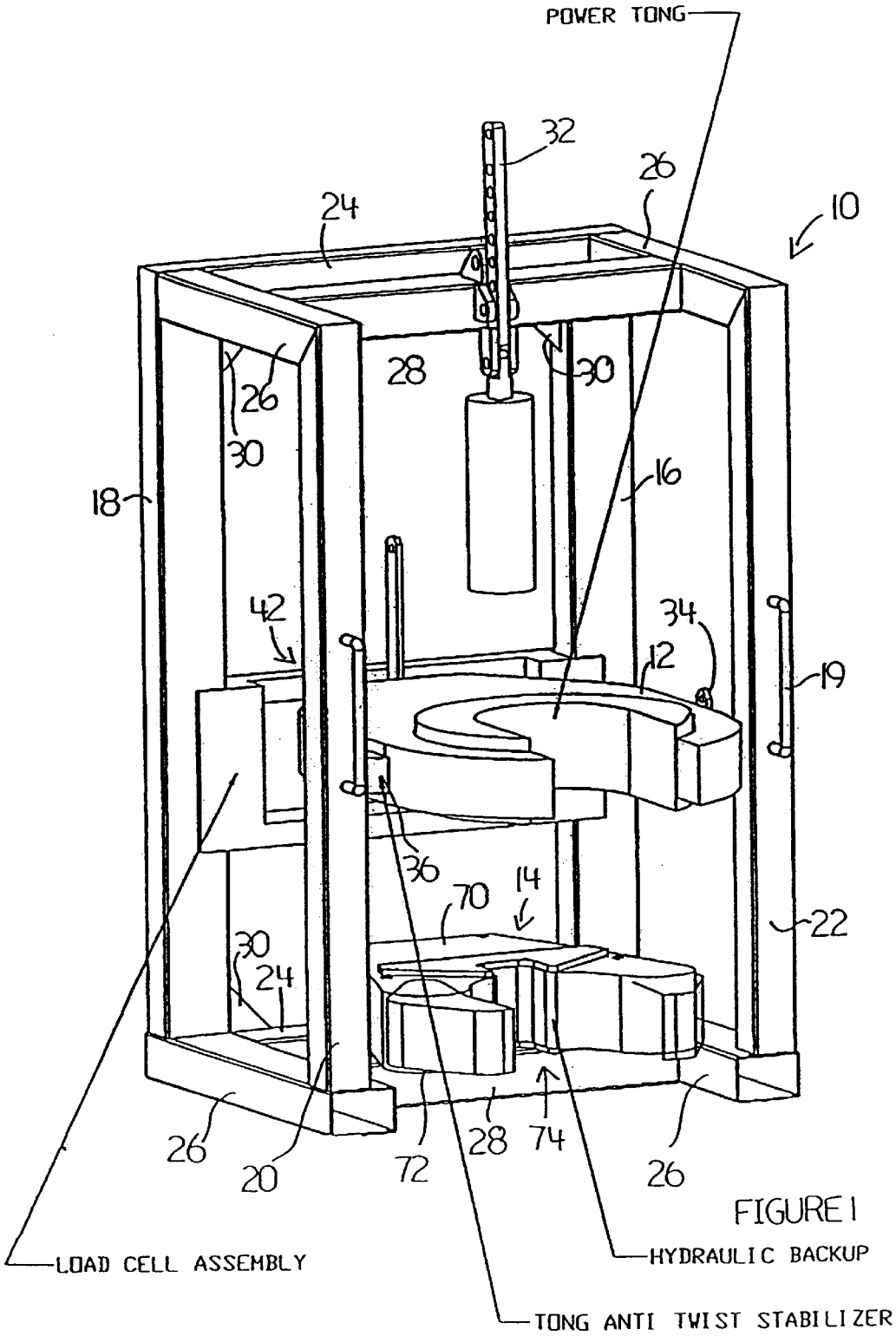
FIG. 1 is a perspective view of a power tong system according to the invention.

Referring to FIG. 1, a power tong system is shown with a frame 10, power tong 12 and backup tong 14. The frame 10 is formed of a pair of rear legs 16, 18 forming a rear support and front legs 20, 22 forming a front support. Conventional handles 19 are provided on the legs 16–22 for ease of handling. The rear legs 16, 18 are connected together by cross-members 24, and the front and rear legs are connected by cross-members 26. A further pair of cross-members 28 complete the frame 10 by connecting between the members 26. These legs and cross-members 16–28 are conveniently formed of square or rectangular irons welded together with suitable wedge reinforcements 30. The entire frame 10 is designed to be hung in conventional manner in operation on a rig by a chain (not shown) connected to the connector mechanism 32.

The power tong 12 is mounted in the frame 10 so that it extends transversely between the two front legs 20, 22. The power tong 12 is conventionally mounted by hanging with chains (not shown) connected to the hook attachments 34. The front legs 20, 22 form a guide preventing transverse motion of the power tong 12 while allowing vertical movement of the power tong 12. To accomplish the guide function, there must be clearance between the sides of the power tong 12 and the legs 20, 22, and the clearance cannot be so great that during operation of the power tong 12 in normal use the sides of the power tong 12 do not come into contact with the legs 20, 22, since it is the contact with the legs 20, 22 that creates the guide function. This is illustrated in FIGS. 5, 6, 7 and 10.

Conveniently, the power tong 12 is provided with stabilizers 36 mounted on either side of the power tong 12, with the stabilizers 36 providing the contact point between the legs 20, 22 and the sides of the power tong 12. The stabilizers 36 may be formed of a hard wearing roller 38 on a shaft 39 held between a pair of flanges 40 welded to the sides of the power tong 12. Although a semi-circular wedge could be used in place of the roller 38, it is preferred to use a roller since this reduces friction between the power tong 12 and the legs 20, 22, and thus helps reduce errors in readings on the load cell 44.

Figure 6:
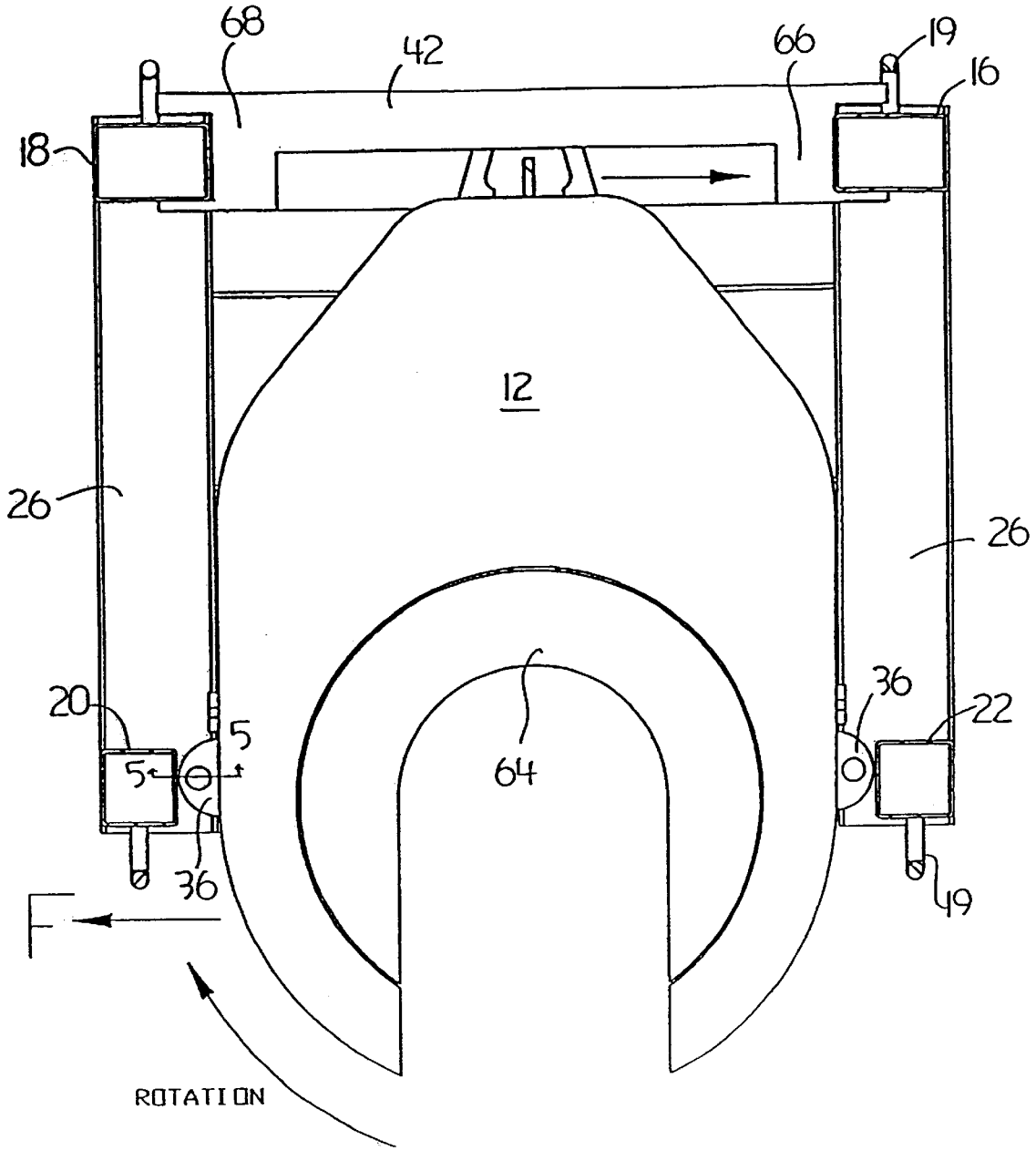
FIG. 6 is a top plan view of power tong used in the embodiment shown in FIG. 1, showing forces induced by clockwise rotation of tubulars.
Figure 7:
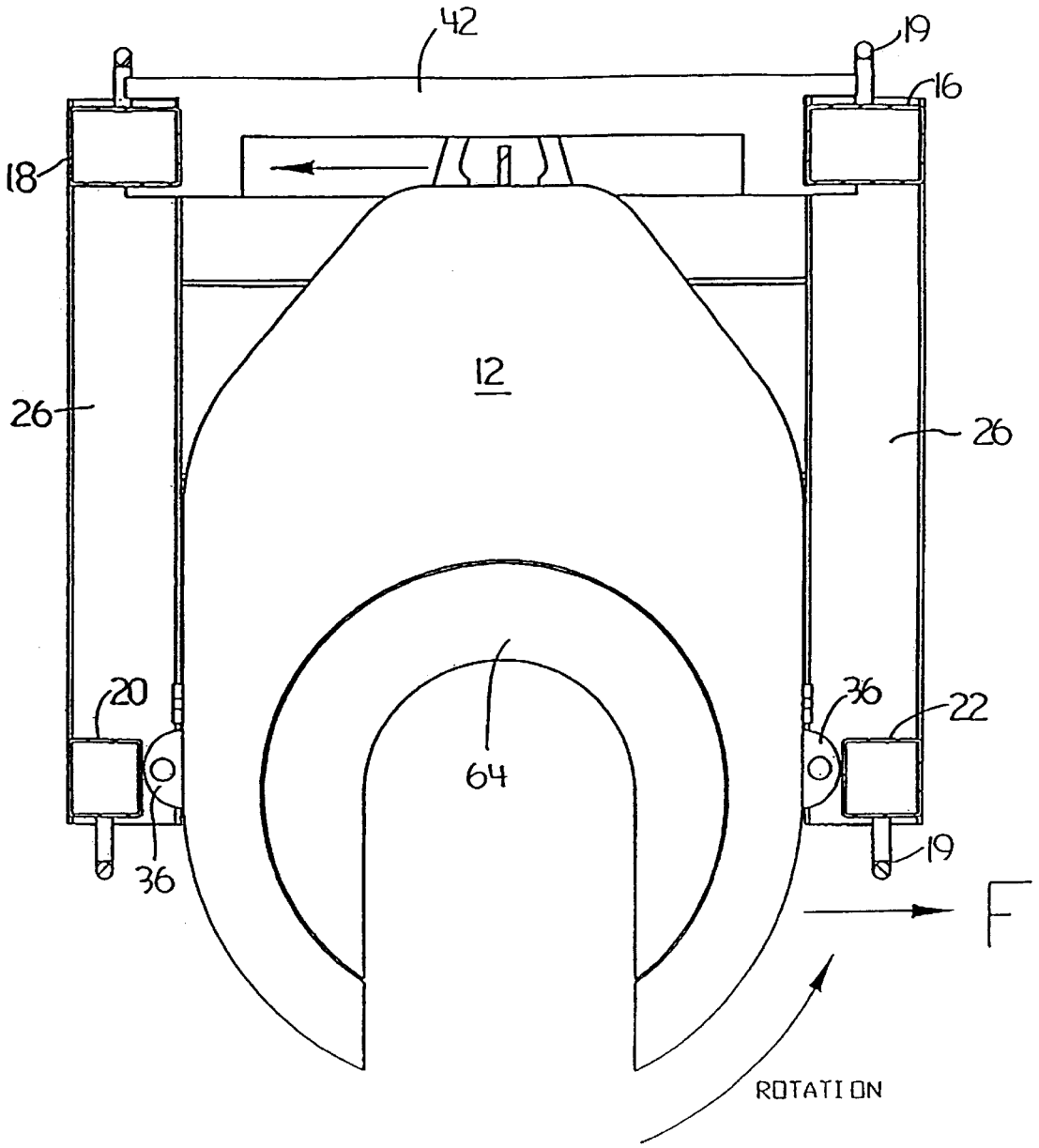
FIG. 7 is a top plan view of power tong used in the embodiment shown in FIG. 1, showing forces induced by anti-clockwise rotation of tubulars.
Figure 10:
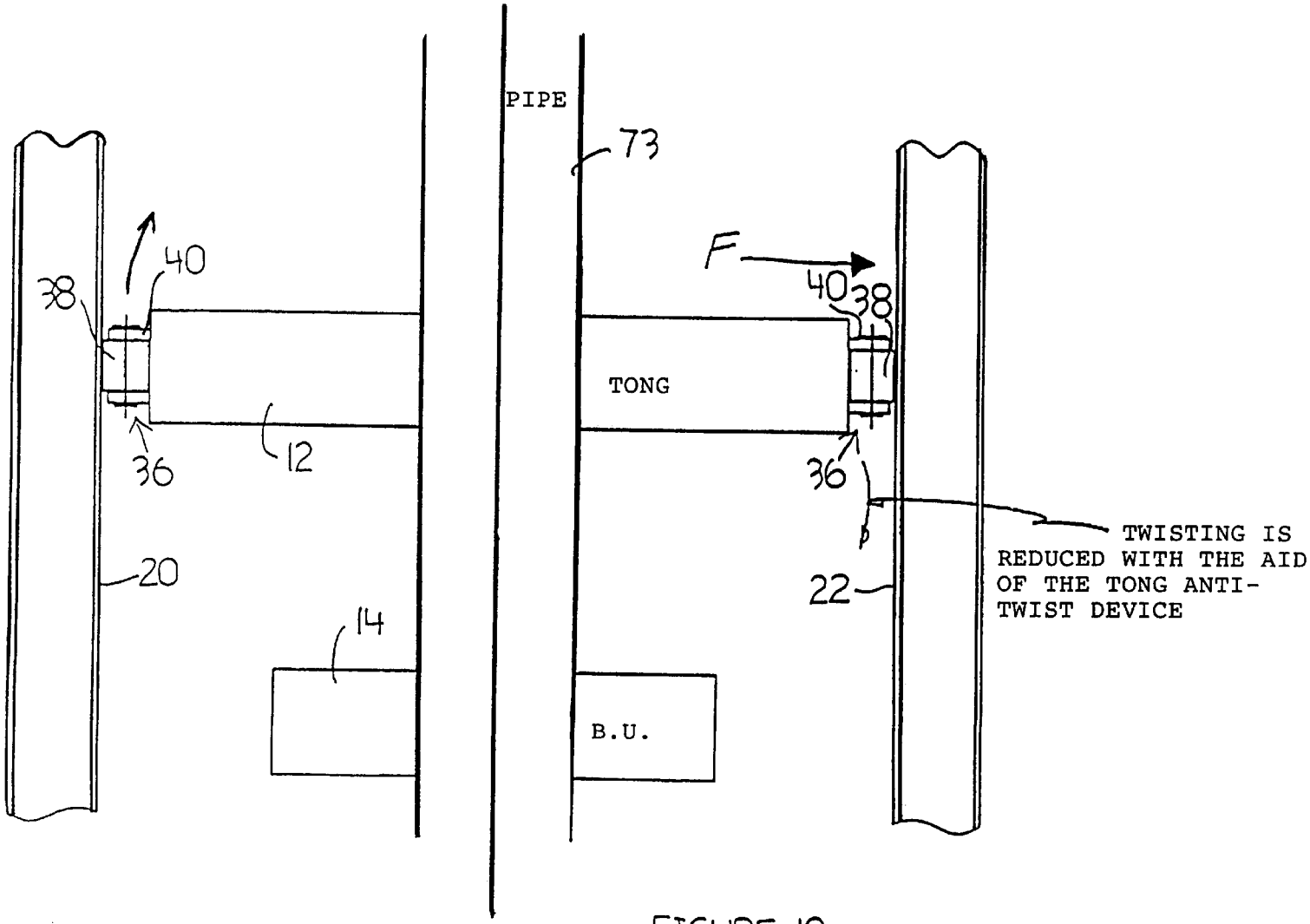
FIG. 10 is a schematic showing motion restraint imposed on the power tong by the frame of the power tong system.

The operation of the torque stabilization system is illustrated in FIGS. 6, 7 and 10. As the ring gear 64 of the power tong 12 rotates to make up or break a threaded joint, either by clockwise movement (FIG. 6) or anti-clockwise (FIG. 7) movement, a lateral or transverse force F is imparted to the power tong 12 which tends to make the tong move laterally in the direction of the force F. In addition, the power tong 12 also tends to rotate about a central longitudinal axis as shown in FIG. 10. The legs 20, 22 prevent lateral motion of the power tong 12 beyond the amount of clearance between the stabilizers 36 and the legs 20, 22, and this has the effect of reducing the amount of rotation. For a power tong about three feet wide, the reduction of movement, with a typical amount of force for making up a threaded joint, is in the order of 87%, corresponding to a reduction of rotational movement at the stabilizers 36 from a total movement of about 2 inches to ¼ in.

Figure 8:
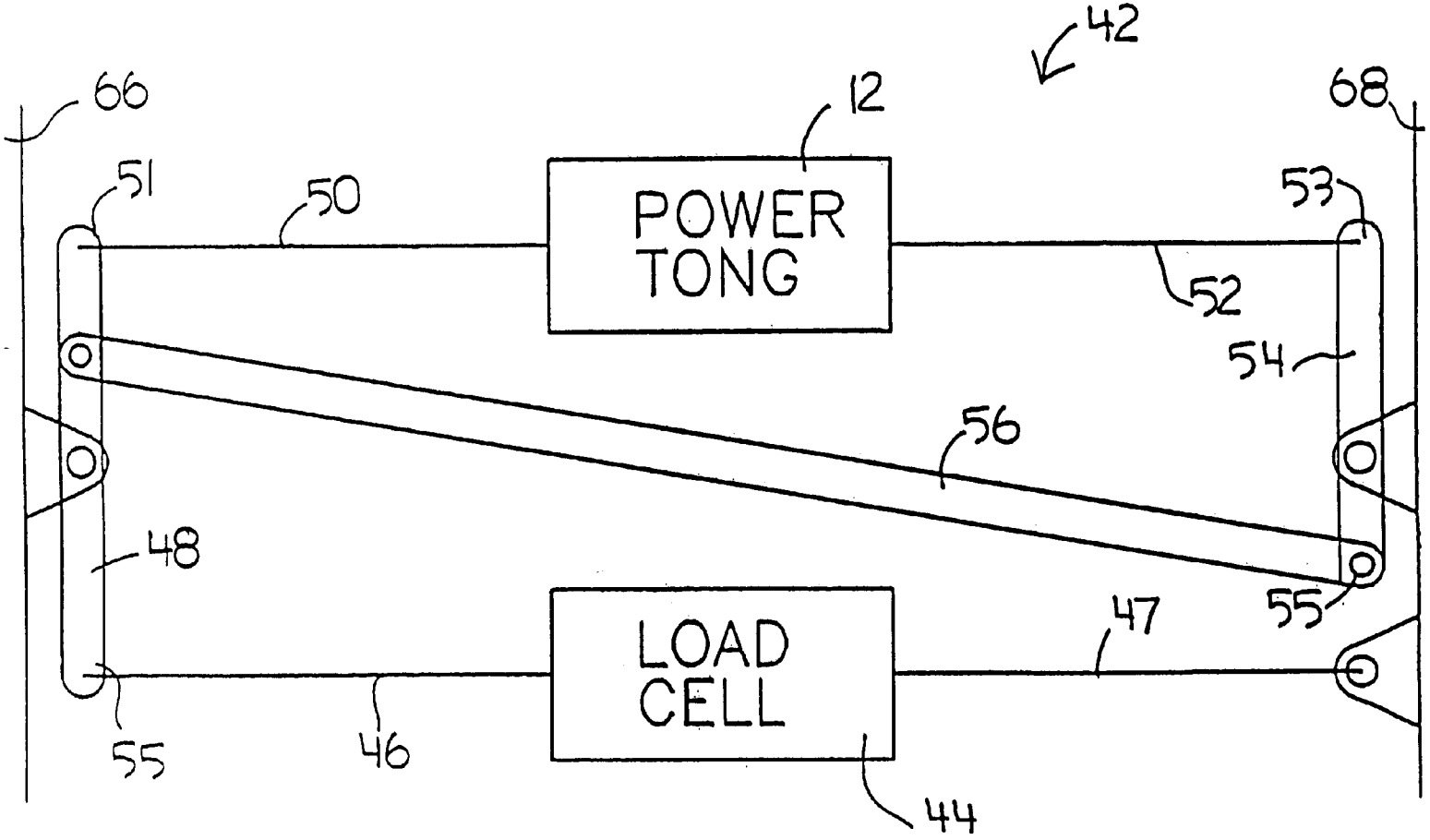
FIG. 8 is a schematic showing a first embodiment of a load cell assembly according to an aspect of the invention.
Figure 9:
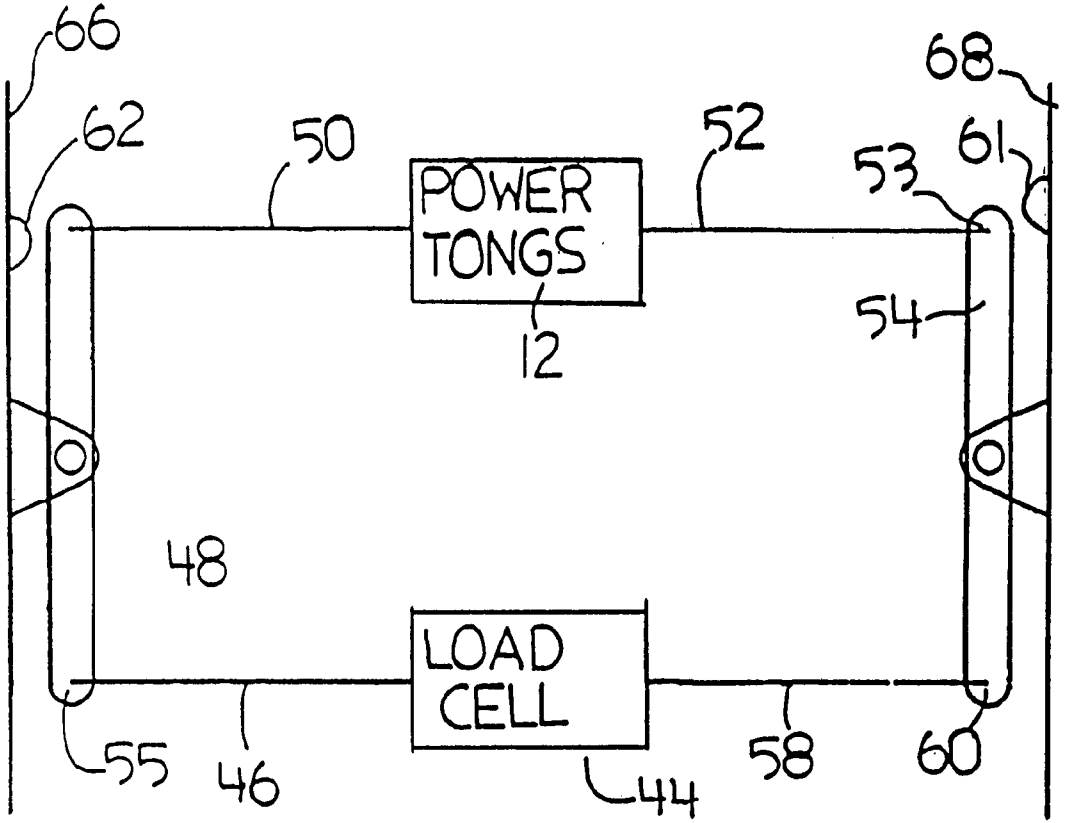
FIG. 9 is a schematic showing a second embodiment of a load cell assembly according to an aspect of the invention.

Referring now to FIGS. 1, 8 and 9, the power tong system also preferably includes a load cell assembly 42 mounted between the rear legs 16 and 18. The load cell assembly 42 is formed of a load cell frame which is mounted between the rear legs 16 and 18 of the power tong frame and a load cell 44 linked by a series of links to the power tong 12 such that movement by the power tong 12 in either of two transverse directions (towards or away from the respective legs 16, 18) loads the load cell 44.

In one embodiment, shown in FIG. 8, the links comprise bars 48 and 54 pivotally mounted respectively on walls 66, 68 of the frame of cell assembly 42. The power tong 12 is connected by a link 50 which attaches to end 51 of the bar 48, and on the other side of the power tong 12 by a link 52 to an end 53 of the bar 54. Each of the links 50 and 52 should be loosely connected so that they only pull one way on the bars 48, 54. Thus, the links 50 and 52 may be made of chains or wires, which may pull on the ends 51, 53, but which cannot push on them. Other one way links of this type may be used such as rods with slots in them. A load cell end 55 of the bar 48 is coupled by link 46 (which may also be a one way link) to the load cell 44 and by link 47 to leg 18. Link 47 anchors the load cell 44. The power tong end 51 of the bar 48 is pivotally connected by a rigid rod 56 to the end 55 of the bar 54.

The load cell assembly of FIG. 8 operates as follows. Upon movement of the power tong 12 towards leg 18, link 50 pulls on bar 48, without pushing on bar 54. Bar 48 rotates about its pivot and loads the load cell 44 through link 46. Upon movement of the power tong 12 towards leg 16, link 52 pulls on bar 54, without pushing on bar 48. Bar 54 rotates about its pivot and cross-link 56 pulls on bar 48, which rotates on its pivot to load the load cell 44 through link 46.

An alternative embodiment of load cell assembly is shown in FIG. 9. In this case, load cell ends 55 and 60 of both the bars 48 and 54 respectively are coupled to the load cell 44 by links 46 and 58 respectively. In addition, cross-link 56 is removed. Stops 61 and 62 limit rotation of the bars 54 and 48 respectively. The embodiment of FIG. 9 works as follows. Upon movement of the power tong 12 towards leg 18, link 50 pulls on bar 48, without pushing on bar 54. Bar 48 rotates about its pivot and loads the load cell 44 through link 46. The link 58 forms an anchor for the load cell 44 since rotation of bar 54 in this instance is prevented by stop 61. Upon movement of the power tong 12 towards leg 16, link 52 pulls on bar 54, without pushing on bar 48. Bar 54 rotates about its pivot to load the load cell 44 through link 58. The link 46 forms an anchor for the load cell 44 since rotation of bar 48 in this instance is prevented by stop 62.

Figure 2:
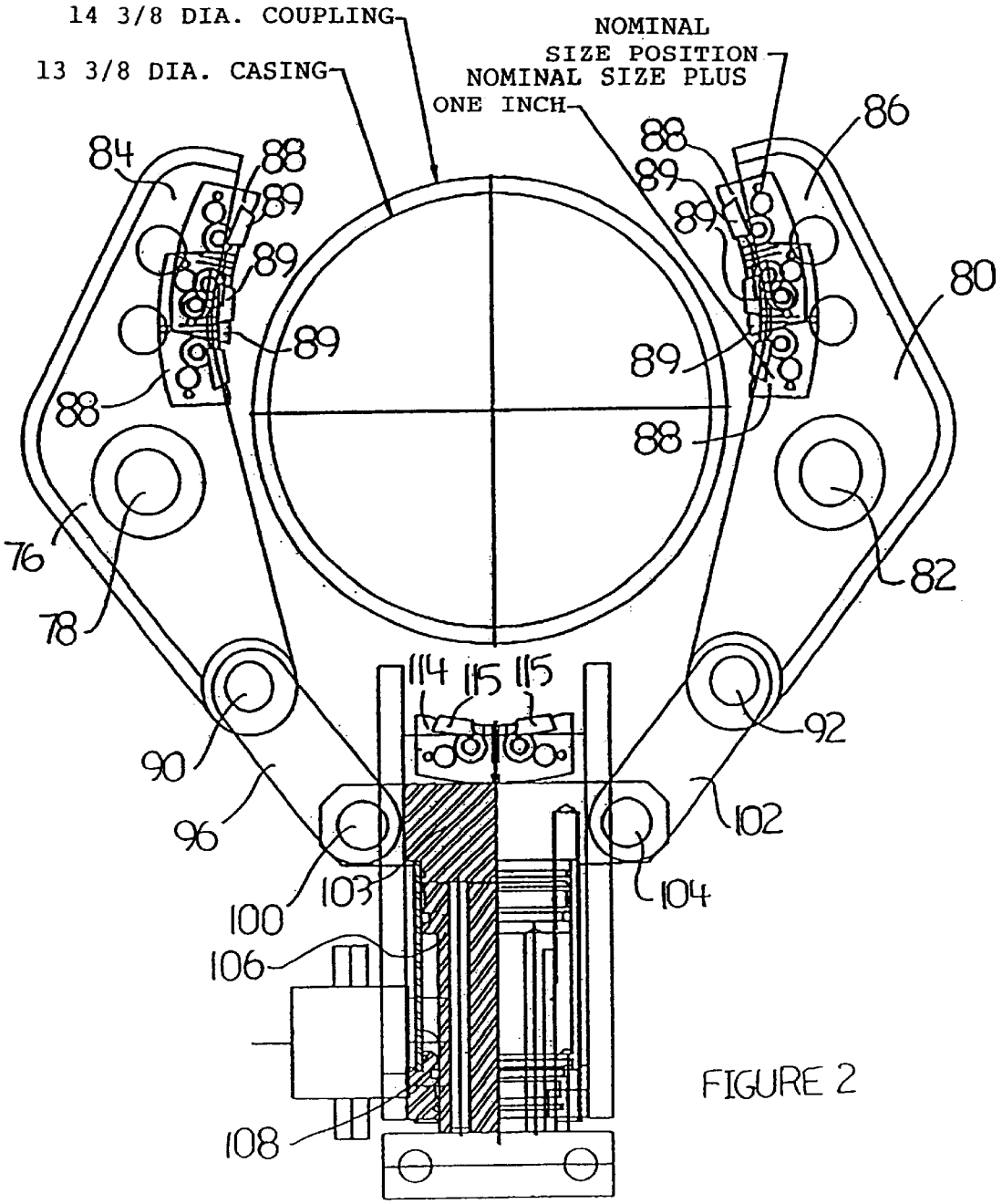
FIG. 2 is a top plan view, partly in section, of backup tong for use in the power tong system of FIG. 1, showing two positions of the dies on the jaws, with the jaws open.
Figure 3:
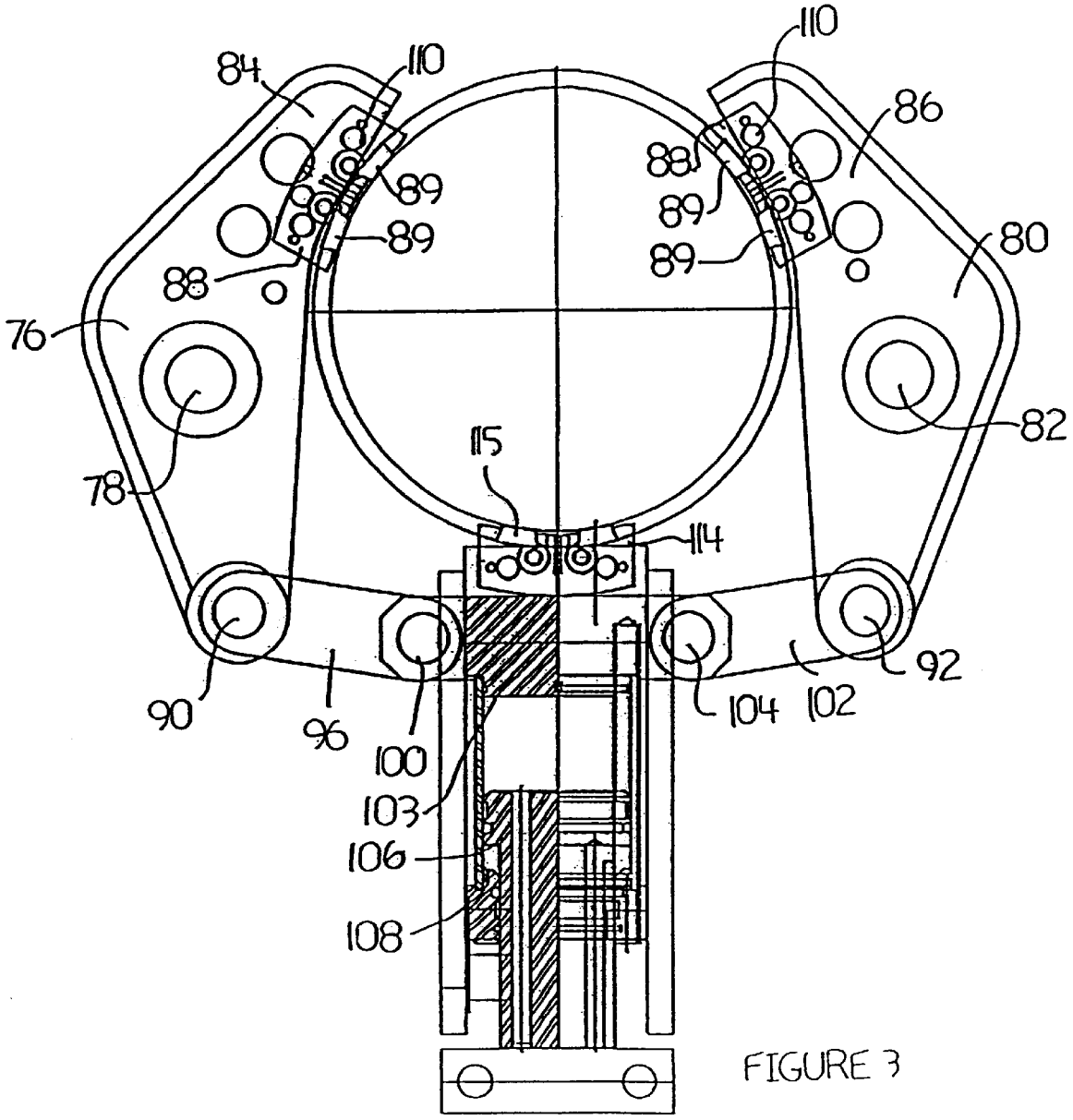
FIG. 3 is a top plan view of the backup tong of FIG. 2 with the jaws closed in nominal position.
Figure 4:
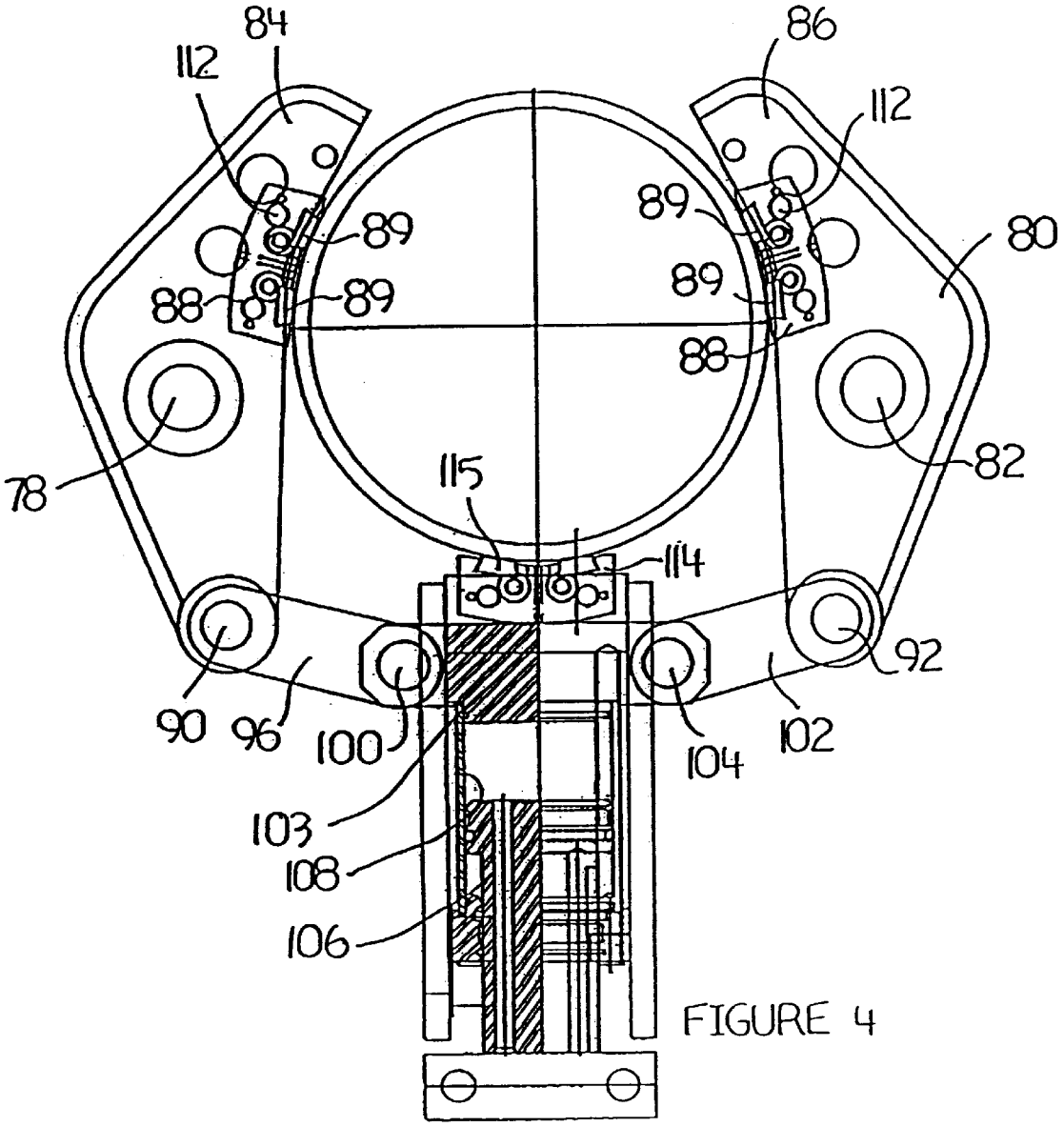
FIG. 4 is a top plan view of the backup tong of FIG. 2 with the jaws closed in nominal plus 1 inch position.
Figure 5:
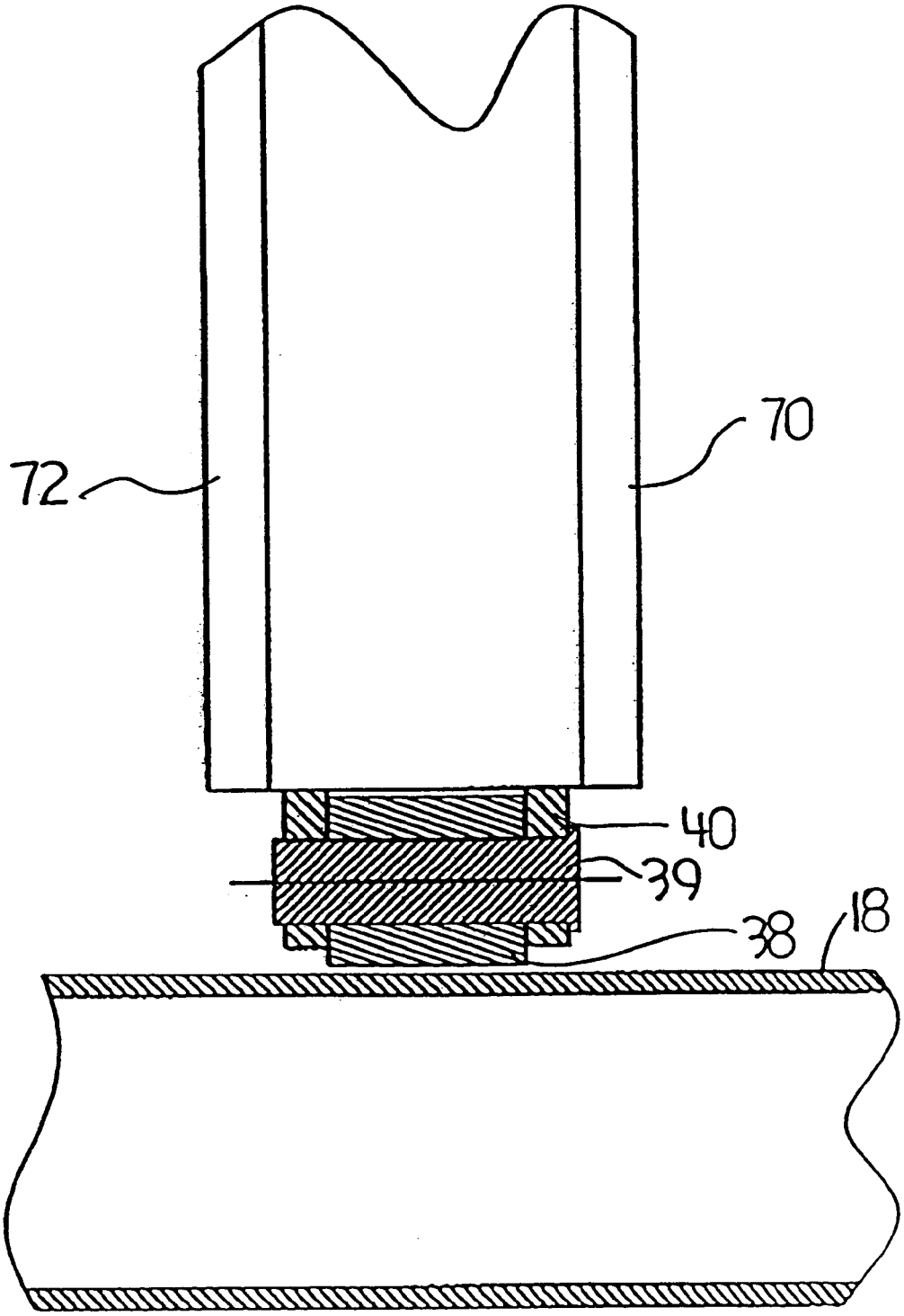
FIG. 5 is a section along the line 5—5 in FIG. 6.

The power tong system also provides an improved backup tong 14. The backup tong 14 are mounted on the frame 10 by conventional manner, as by bolts, to the cross-members 24 and 28. Referring to FIGS. 2–4, the backup tong may be formed of an upper mounting plate 70 and a lower mounting plate 72 connected together in conventional manner to form a housing. Each of the upper mounting plate 70 and lower mounting plate 72 have a bight defining a throat 74 for receiving a tubular 73 (FIG. 10). The upper mounting plate 70 is spaced from the lower mounting plate 72 with the bights aligned.

A jaw 76 is pivotally mounted on a pivot 78 between the upper mounting plate 70 and the lower mounting plate 72 on one side of the throat 74 for pivotal movement about an axis perpendicular to the upper and lower mounting plates 70, 72. Another jaw 80 is pivotally mounted on a pivot 82 between the upper mounting plate 70 and the lower mounting plate 72 on the other side of the throat 74 for pivotal movement about an axis perpendicular to the upper and lower mounting plates 70, 72.

Each jaw 76, 80 includes a die end 84, 86 respectively, on which die carriers 88 carrying dies 89 are mounted. Each jaw 76, 80 also has a link end 90, 92 respectively, the die ends 84, 86 and the link ends 90, 92 being on opposed sides of the respective pivots 78, 82.

A linear actuator 94 is mounted on the housing to actuate the jaws 76, 80. The linear actuator 94 may be a hydraulic actuator, many of which are known in the art, with fixed piston 106 inside movable cylinder 108. A rigid link 96 is pivotally connected to the link end 90 of the jaw 76 and is pivotally connected at pivot 100 to a head 103 on the cylinder 108 of the linear actuator 94. A rigid link 102 is pivotally connected to the link end 92 of the jaw 80 and is pivotally connected to the head 103 on the cylinder 108 of the linear actuator by pivot 104.

Two die carrier seats are preferably provided on each jaw 76, 80. Both die positions are shown in FIG. 2. In FIG. 3, a die position is shown for a tubular of nominal diameter. The die carrier seat is defined by holes in the jaws that receive pins 110. In FIG. 4, a die position is shown for a tubular of nominal plus 1 inch diameter. The die position is further inward in the throat 74 of the housing, and is defined by holes in the jaws that receive pins 112. Further die carrier seats, also in different positions, may also be provided. Several dies may also be used at the same time on each jaw, so as to provide wrap-around dies.

A further die carrier 114 carrying dies 115 is mounted on a side of the throat 74 opposed to both the die carriers 88. This die carrier 114 may be mounted on the housing adjacent the linear actuator 94 or may be mounted on the linear actuator 94 as shown and the dies 115 brought into contact with a tubular when the linear actuator 94 pushes on the jaws 76, 80 to close them. A conventional hydraulic power supply is provided for the hydraulic actuator. Preferably, the hydraulic actuator 94 is aligned with the throat 74 (the longitudinal axis of the actuator passes through the center line of the throat 74), and the die carriers 88 disposed symmetrically on either side of the throat 74 so that the die carriers 76, 80 and 114 are approximately separated by 120° of arc.

Any of various conventional load cells may be used for the load cell. Also, any of various conventional power tongs may be used for the power tong, such as the power tong made by Universe Machine Corporation of Edmonton, Alberta, Canada.

A person skilled in the art could make immaterial modifications to the invention described in this patent document without departing from the essence of the invention that is intended to be covered by the scope of the claims that follow.

The embodiments of the invention in which an exclusive property or privilege is claimed are defined as follows:

1. A tong system, comprising:

a frame having a rear support and a front support, the front support comprising a first front leg and a second front leg;

a tong mounted in the frame with the tong extending transversely between the first front leg and he second front leg, the first front leg and the second front leg forming a guide limiting movement of the tong in a transverse direction while allowing movement of the tong in a vertical direction;

a first stabilizer on a first side of the tong and a second stabilizer on a second side of the tong, in which, in use, the first stabilizer abuts against the first front leg and the second stabilizer abuts against the second front leg to limit transverse motion of the tong; and the first stabilizer and the second stabilizer each comprise a roller having an axis, each roller being oriented with the axis of the roller perpendicular to the transverse direction and parallel to the vertical direction.

2. The tong system of claim 1 in which the rear support comprises a first rear leg and a second rear leg connected by first cross-members, the first rear leg being connected to the first front leg by a second cross-member and the second rear leg being connected to the second front leg by a third cross-member.

3. The tong system of claim 2 further comprising:

a load cell assembly mounted between the first rear leg and the second rear leg.

4. The tong system of claim 3 in which the load cell assembly comprises:

a load cell licked by a series of links to the tong such that movement by the tong in either of two transverse directions loads the load cell.

5. The tong system of claim 4 in which the links comprise:

a load cell frame having a first side and a second side;

a first bar pivotally mounted on the first side of the load cell frame;

a second bar pivotally mounted on the second side of the load cell frame;

the tong being linked on a first side to a tong end of the first bar and on a second side to a tong end of the second bar; and a load cell end of at least one of the first bar and the second bar being coupled to the load cell.

6. The tong system of claim 5 in which the first bar is coupled to the load cell and further comprising:

a cross-link interconnecting the tong end of the first bar and an end of the second bar opposed to the tong end of the second bar.

7. The tong system of claim 5 in which:

load cell ends of both the first bar and the second bar are coupled to the load cell.

8. A tong and load cell system, comprising:

a frame having a rear support and a front support;

a tong mounted in the frame;

the rear support comprising a first leg and a second leg connected at opposed ends by cross-members;

a load cell assembly mounted between the first leg and the second leg; and the load cell assembly comprising a load cell linked by a series of links to the tong such that movement by the tong in either of two transverse directions loads the load cell.

9. The tong and load cell system of claim 8 in which the links comprise:

a first bar pivotally mounted on a first side of the load cell assembly;

a second bar pivotally mounted on a second side of the load cell assembly;

the tong being linked on a fist side to a tong end of the first bar and on a second side to a tong end of the second bar; and a load cell end of at least one of the first bar and the second bar being coupled to the load cell.

10. The tong and load cell system of claim 9 in which the first bar is linked to the load cell and further comprising:

a cross-link interconnecting the tong end of the first bar and an end of the second bar opposed to the tong end of the second bar.

11. The tong and load cell system of claim 9 in which:

load cell ends of both the first bar and the second bar are coupled to the load cell.

12. A backup tong, comprising:

a housing comprising an upper mounting plate and a lower mounting plate, each of the upper mounting plate and lower mounting plate each defining a throat for receiving a tubular, the upper mounting plate being spaced from the lower mounting plate with the throats aligned;

a first jaw pivotally mounted on a first pivot between the upper mounting plate and the lower mounting plate on one side of the throat for pivotal movement about an axis perpendicular to the first and second mounting plates;

the first jaw including a die end on which a first die is mounted and a link end, the die end and link end being on opposed sides of the first pivot;

a second jaw pivotally mounted on a second pivot between the upper mounting plate and the lower mounting plate on another side of the throat for pivotal movement about an axis perpendicular to the first and second mounting plates;

the second jaw including a die end on which a second die is mounted and a link end, the die end and the link end being on opposed sides of the second pivot;

a linear actuator counted on the housing;

a first rigid link pivotally connected to the link end of the first jaw and pivotally connected to the linear actuator;

a second rigid link pivotally connected to the link end of the second jaw and pivotally connected to the linear actuator; and a third die mounted on the linear actuator at a third side of the throat.

13. The backup tong of claim 12 in which at least one of the first jaw and the second jaw comprises plural die seats for receiving a die in different locations along the respective one of the first jaw and second jaw.

14. The backup tong of claim 13 in which each of the first jaw and the second jaw comprise plural die seats for receiving a die in different locations along the respective first jaw and second jaw.

15. The backup tong of claim 12 in which the linear actuator is a hydraulic actuator aligned with the throat.

16. The backup tong of claim 12 in which:

the first rigid link is pivotally connected to a third pivot on a first side of the linear actuator; and the second rigid link is pivotally connected to a fourth pivot on a second side of the linear actuator, the third and fourth pivot points being located separately from each other.

17. The backup tong of claim 16 in which the third pivot point and the fourth pivot point are spaced apart on opposed sides of the third die.

18. A tong system, comprising:

a frame having a rear support and a front support;

the front support comprising a first front leg and a second front leg;

the rear support comprising a first rear leg and a second rear leg connected by first cross-members, the first rear leg being connect to the first front leg by a second cross-member and the second rear leg being connected to the second front leg by a third cross-member;

a tong mounted in the fare with the tong extending transversely between the first front leg and the second front leg, the first front leg and the second front leg forming a guide limiting transverse motion of the tong while allowing vertical movement of the tong; and a load cell assembly mounted between the first rear leg and the second rear leg, the load cell assembly comprising a load cell linked by a series of links to the tong such that movement by the tong in either of two transverse directions loads the load cell.

19. The tong system of claim 18 in which the links comprise:

a load cell frame having a first side and a second side;

a first bar pivotally mounted on the first side of the load cell frame;

a second bar pivotally mounted on the second side of the load cell frame;

the tong being linked on a first side to a tong end of the first bar and on a second side to a tong end of the second bar; and a load cell end of at least one of the first bar and the second bar being coupled to the load cell.

20. The tong system of claim 19 in which the first bar is coupled to the load cell and further comprising:

a crosslink interconnecting the tong end of the first bar and an end of the second bar opposed to the tong end of the second bar.

21. The tong system of claim 19 in which:

load cell ends of both the first bar and the second bar are coupled to the load cell.

* * * * *